United States Patent [19]

Yeadon

[11] 4,445,902

[45] May 1, 1984

[54] VAPOR PROCESS FOR MINERAL DYEING CELLULOSIC FABRICS

[75] Inventor: David A. Yeadon, New Orleans, La.

[73] Assignees: The United States of America as represented by the Secretary of Agriculture, Washington, D.C.

[21] Appl. No.: 491,151

[22] Filed: May 4, 1983

[51] Int. Cl.[3] ..... C09B 67/00

[52] U.S. Cl. ..... 8/474; 8/635; 8/645; 8/918

[58] Field of Search ..... 8/474, 635, 645

[56] References Cited

U.S. PATENT DOCUMENTS 3,794,466 2/1974 Conner ..... 8/645
3,915,631 10/1975 Conner ..... 8/645
3,917,446 11/1975 Conner ..... 8/645

*Primary Examiner*—A. Lionel Clingman
*Attorney, Agent, or Firm*—M. Howard Silverstein; David G. McConnell; Raymond C. VonBodungen

[57] ABSTRACT

A vapor process for mineral dyeing cotton textiles is disclosed. Cellulosic fabric is impregnated with a chromium solution, exposed to sulfur dioxide vapors, dried, cured, and washed. The result is a superior process to "pearl gray" mineral dye fabric. Chromium containing salts used in the pad bath are selected from the group consisting of $(NH_4)_2Cr_2O_7$; $K_2CrO_4$; $(NH_4)_2CrO_4$, $Na_2CrO_4$; $Na_2Cr_2O_7$; and $K_2Cr_2O_7$. The pad baths contain from about 3.5% to 5.0% chromium consisting of 40 to 50 parts of a 20 to 28% sodium dichromate dihydrate solution made alkaline with 25 to 50 parts of 10 to 20% sodium hydroxide solution to attain a pH of about 9.6 to 13.0 with about 0.5 parts of wetting agent and 0–30 parts of water. A pad bath comprising about 3 parts of ammonium dichromate, 7.5 parts ammonium carbonate, 0.6 parts zirconyl ammonium carbonate and 0.5 parts wetting agent in about 90 parts water, reacted with about 40 parts concentrated ammonium hydroxide to result in a final pH of about 11, can also be used.

5 Claims, No Drawings

VAPOR PROCESS FOR MINERAL DYEING CELLULOSIC FABRICS

BACKGROUND OF THE INVENTION (1) Field of the Invention

This invention relates to a vapor process for mineral dyeing cellulosic textile fabrics.

(2) Description of the Prior Art

Green mineral dyeing of cellulosics has been accomplished in prior art processes designated as "pearl gray" finishing. Heretofore, soluble chromium compounds, principally chromic chloride, were padded on cellulosics, dried and then converted to hydrated chromium oxide when wetted with an alkali hydroxide or carbonate solution. This is followed by heat curing to produce insoluble greenish chromium oxide deposit in the cellulosic achieving "mineral dyeing". Such treated fabrics have many uses and applications for items which are subjected to humid or outdoor environments such as tents, awnings, tarpaulins, beach fabric, curtains, boat and marine covers, etc.

Mineral dyeing is applied by double decomposition techniques wherein several baths and washings are required, or by treatment with a "single bath" obtained by mixing a higher valent Cr(VI) solution with a reducing chemical solution that results in developing the insoluble greenish chromium (III) oxide to "mineral dye" the cellulosic fabric. The double decomposition process requires at least two paddings of the fabric with separate treatment baths, drying or heat treatments, and a final washing and drying. Effluents from treatment and washing baths contain appreciable amounts of chromium (III). Problems arise in preventing environmental pollution from disposing of such waste materials. The referred to "single bath" process of the prior art avoids some of these just mentioned problems. This treatment bath, prepared by mixing the chromium solution and reducing solution, has limited useful life, being stable as a padding mixture for usually just about a day or so after mixing.

SUMMARY OF THE INVENTION

Applicant discloses a vapor process for mineral dyeing cotton textiles. Cellulosic fabric is impregnated with an alkaline chromium solution. The yellow chromium wetted cellulosic fabric is then exposed to sulfur dioxide vapors and the resultant greenish colored cellulosic fabric is heat cured to an insoluble mineral dyed fabric. The residual and resultant unwanted salts, alkali, etc., are then washed with a sufficient quantity of water for removal.

The cellulosics mineral dyed by the present inventions are similar in color to those obtained by the aforementioned processes but initially have a "brighter green" coloration. This coloration is quite attractive and would be as useful, effective, and accepted as are the conventional "pearl gray" mineral dyed fabrics. The mineral dyeing is the same in either process, and either imparts comparable protection to actinic and weather degradation of the cellulosics. As discussed in the single bath prior art process described earlier, the preferred embodiments of applicant's invention is also applied by a single bath treatment, but applicant's single bath treatment, in contrast to that of the prior art process, has unlimited stability as it is a true solution of the principal ingredient, the chromium (VI) component. As such, it may be used anytime after preparation. In applicant's invention the insoluble chromium oxide "mineral dye" is developed in the impregnated cellulosic by reducing the chromium (VI) to the chromium (III) when exposing the impregnated cellulosic to the reducing gas, sulfur dioxide. This is also accomplished by applicant without an intermediate drying step and without an alkali precipitation bath that will increase in chromium (III) content as finishing proceeds. This avoids pollution problems in disposing of such waste effluents.

It is a primary object of this invention to provide an improved method for producing a "pearl gray" mineral dyed cellulosic textile.

A second object of this invention is to provide a simple padding-gas exposure-heat cure process to pearl gray mineral dye cellulosic textile materials.

A third object of this invention is the requirement of a single pad bath for treatment and curing, thus eliminating the need for an additional drying and alkali precipitation bath as employed in conventional "pearl gray" mineral dye processing.

A fourth objective of this invention is to minimize the chemical and processing controls required in applying mineral dyeing finishes by the current art.

A fifth objective of this invention is to reduce the potential for contributing to environmental stream pollution through elimination of the chromium oxide precipitation bath of conventional "pearl gray" mineral dyeing with its inherent development of a high chromium (III) content, and its subsequent potential effluent disposal into the environment, or necessitating a costly chromium recovery process to avoid pollution.

DESCRIPTION OF THE PREFERRED EMBODIMENTS

Applicant's invention can be described as a novel process for imparting a "pearl gray" colored mineral dyeing to cellulosic textile that offers resistance to actinic degradation and weather exposure, with such properties being provided to the finished products from a single bath treatment by:

(a) impregnating the cellulosic material with an aqueous solution containing about from 1% to 5% chromium metal in the form of a hexavalent chromium compound selected from the group consisting of sodium chromate, potassium chromate, ammonium chromate, sodium dichromate, and ammonium dichromate, and potassium dichromate that has been adjusted to a highly alkaline pH, of between 10.0 and 13.9, with about from 10% to 50% sodium hydroxide, and (b) removing the excess treating solution from the impregnated cellulosic to result in about from 40% to 60% wet pickup, then (c) exposing the wet impregnated cellulosic textile to an environment of sulfur dioxide gas for about from 0.25 to 15 minutes, and followed by (d) drying and curing the impregnated and sulfur dioxide treated cellulosic materials at about from 3 to 15 minutes at a temperature of about from 150° C. to 180° C., and (e) washing to remove the residual salts and alkali from the essentially insoluble chromium oxide mineral dyed textile with subsequent drying at about 110° C. for from about 2 to 5 minutes.

Applicant's process varies in step (a) above, when zirconyl ammonium carbonate and/or ammonium carbonate are included to promote retention of the subsequently formed chromium oxide in the fabric, being used with or in place of the sodium hydroxide to raise the pH of the aqueous solution of the hexavalent chromium compound, and the wording of step (a) should then read:

(a) impregnating the cellulosic material with an aqueous solution containing from about 1% to 5% chromium metal in the form of a hexavalent chromium compound selected from the group consisting of sodium chromate, potassium chromate, ammonium chromate, sodium dichromate, potassium dichromate and ammonium dichromate, with sufficient zirconyl ammonium carbonate to represent about from 0.2% to 2% $ZrO_2$, and about from 1% to 4% sodium hydroxide, or 1% to 15% ammonium carbonate.

The prior art using acid chromium solutions, such as chrome chloride, teaches that drying them as fabrics will tender the fabrics. However, applicant dries the fabric after reduction to the green chromium (III) stage indicated with no significant reduction of fabric strength.

The prior art generally teaches applications of water repellent as a subsequent treatment of the pearl gray mineral dyed fabric, but in this invention a water repellent incorporated into the initial alkaline hexavalent chromium treatment bath produces pearl gray mineral dyed fabrics that are water repellent.

To illustrate the invention and particular aspects of its usefulness the following examples are presented. These are not to be understood as limiting the invention in any way whatsoever.

EXAMPLE 1

To 1.5 g ammonium dichromate dissolved in 18.5 g deionized water was added 10% sodium hydroxide until a pH of about 13–14 was reached. The originally orange colored solutions became bright yellow on alkalization (Solution A). A piece of scoured and bleached, 9 oz cotton duck fabric was padded with this solution, blotted to remove excess liquid, exposed for about 10 minutes to an $SO_2$ gas environment in a covered beaker containing sulfurous acid (6% $SO_2$ content). The yellow fabric turned a greenish pearl gray color. It was dried and cured in a 160° C. forced draft oven for 5 minutes. The cured green-pearl gray colored fabric showed no evidence of leaching when immersed in running water for 10 minutes.

EXAMPLE 2

A padding solution (B) for treatment of textile fabric was prepared to contain about 3.5% chromium from 200 g of 15% sodium dichromate solution by adjusting its pH with 94 ml of 10% sodium hydroxide to a pH of about 13.95, and finally, adding 1.5 g (0.5%) of the wetting agent Discopen 205. Two pieces of 9 oz cotton duck fabrics, the first in the greige state and the second desized, scoured and bleached, were padded with this solution by repeated immersion and squeezing out excess liquid until wet pickups of about 40% and 60%, respectively, were accomplished. The wetted fabrics were immediately exposed, at atmospheric pressure in a closed chamber containing sulfur dioxide gas from a compressed gas cylinder for about 6 minutes and about 9 minutes, respectfully. The originally yellow colored wet fabrics, which became a green pearl gray color during exposure, were immediately dried and cured in a forced draft oven at 160° C. for 3 minutes.

Pieces of these mineral dyed fabrics indicated no loss of color after 10 minutes leaching in running water. The mineral dyed desized, scoured and bleached cotton duck fabric had 1.57% chromium and the greige fabric had 1.05% chromium. Padding pieces of these fabrics through a 10% Blu-Wax water repellent bath and drying at 110° C. for 3 minutes produced a slightly dark green color on the fabrics, and they were also indicated resistant to 10 minutes of water leaching.

EXAMPLE 3

A padding solution, similar to "B" in Example 1, used to impregnate cotton textiles, was prepaed by adding 10% sodium hydroxide to a 12.7% solution of ammonium dichromate until a pH of 13.95 was reached and then adding 0.5% of Discopen 205 wetting agent. Desized, scoured and bleached, and greige cotton duck fabrics of about 9 oz/yd$^2$ were impregnated with this yellow solution to about 50% wet pickup, exposed without drying in a sulfur dioxide gas filled reaction chamber for 10 minutes, and then, immediately dried and cured in a 160° oven for 3 minutes to mineral dyed, green-pearl gray colored fabrics. After 10 to 15 minutes washing in running cold water the color of the fabrics appeared the same. The greige cotton fabric contained 0.96% Cr and had a strip breaking strength of 139 lbs/linear inch (the original greige fabric tested at 135 lbs/linear inch).

EXAMPLE 4

A chromium padding solution for mineral dyeing cotton textiles was prepared by adjusting the 9.6 pH of 71 parts of a solution composed of 3% ammonium dichromate, 7.5% ammonium carbonate, 0.6% zirconyl ammonium carbonate, and 0.5% Discopen 205 wetting agent, with 29 parts of concentrated ammonium hydroxide to a pH of 11.1. This yellow and only slightly cloudy solution was used to impregnate pieces of desized, scoured, and bleached, and greige cotton duck fabrics of about 9 oz/yd$^2$ to wet pickups of 54% and 35%, respectively.

The mineral dyed bleached fabric was a somewhat whiter shade and the mineral dyed greige fabric was slightly greyer than the mineral dyed fabrics of the previous examples. After water washing in running water the mineral dyed color may have been only very slightly less intense, but applications of a wax water repellent gave colors similar to that of the originally treated fabrics and more reminiscent of some commercially dyed pearl gray finished cotton duck fabric.

EXAMPLE 5

A padding formulation containing 3.6% chromium, for use in mineral dyeing textiles, was prepared from 450 g of a 20% sodium dichromate dihydrate solution adjusted to a pH of 12.9 with 424 g of an alkali solution containing 58 g of NaOH. Greige cotton duck fabric of about 9 oz/yd$^2$ was padded with this formulation to about 50% to 55% wet pickup. Individual impregnated fabric specimens were exposed in an $SO_2$ gas filled reaction chamber for ¼, ½, 1, 3, 5, 7.5, and 10 minutes, and then immediately dried and cured at 160° C. for 4 minutes to yield green-pearl gray mineral dyed fabrics. Washing for 15 minutes by agitation in water indicated no appreciable loss of chromium from the fabrics. After drying the mineral dyed fabrics analyzed 1.37, 1.34, 1.39, 1.32, 1.43, 1.44, and 1.56% chromium, for the respective increasing $SO_2$-vapor treatment times.

EXAMPLE 6

A pad bath formulation to apply mineral dye, fungicide and water repellent simultaneously was prepared by mixing 2 parts of the pad bath formulations prepared in Example 5 with one part of a commercial fungicide/-water repellent emulsion preparation containing about 13% of pentachlorophenyl laurate and an equal amount of paraffin wax. A piece of 9 oz/yd$^2$ greige cotton duck was impregnated with this composite chromium/fungicide/water repellent formulation to about 50% wet pickup, exposed in an $SO_2$ gas filled reaction chamber, and then dried and cured in an oven at 160° C. for 4 minutes to produce a green-pearl gray mineral dyed textile material. After 15 minutes agitated water washing and then drying, the mineral dyed fabric contained 1.1% chromium and had a spray rating of 100, whereas the 10 minute $SO_2$-vapor treated fabric in Example 5 (comparable conditions without fungicide/water repellent added) had a spray rating of 50.

EXAMPLE 7

To determine the shelf life stability of the alkali-chromium pad bath formulation, 284 g of 20% NaOH was slowly added to 500 g of 28% sodium dichromate dihydrate solution to give a chromium solution with a final pH of 13.0. Five grams (0.5%) of the wetting agent Discopen 205 was added and the formulation made up to 1 kg with 111 kg de-ionized water. The bath then had a pH of about 12.9 and contained about 4.9% chromium. Two pieces of greige 9 oz/yd$^2$ cotton duck were impregnated by padding through 200 ml of this bath to a wet pickup of about 55%, exposed to $SO_2$ vapors in an $SO_2$ gas filled reaction chamber, and then immediately dried and cured in an oven at 160° C. for four minutes. The green-pearl gray mineral dyed fabrics were washed with agitation in about 18 times their weight of water (ambient temperature) and dried. The wash water contained only 44 ppm chromium and the fabrics analyzed 1.73% chromium. Both the unused and used padding bath solutions were stored at room temperatures for three months and the mineral dyeing process of 9 oz greige duck cotton was repeated with these solutions, both of which had a pH of about 13. The resulting washed mineral dyed fabrics contained 1.7% and 1.9% chromium for greige cotton fabrics treated with the "fresh" and "used" padding formulations, respectively, after three months of extended storage with no detectable chromium in the wash waters. All of these washed mineral dyed fabrics had strip breaking strengths similar to that obtained on specimens of the untreated greige cotton duck fabric of about 133–136 lbs/linear inch.

EXAMPLE 8

A treatment bath for conventional application of pearl gray mineral dyeing to cotton textiles was prepared to contain about 5% chromium by mixing 140 g of a commercial "chrome chloride" product in 207 g de-ionized water and adding 3.5 g (1% ) of the wetting agent Discopen 205. Greige cotton duck, 9 oz/yd$^2$ weight, was padded through this bath (pH=1.55) sufficiently to reach about a 57% wet pickup, and was then dried at 110° C. for about 1½ minutes to around 10% moisture content. The dried impregnated fabric was padded through 10% sodium hydroxide (about 20 times the weight of the fabric) to precipitate the chromium oxide mineral dye on the fabric, and then the fabric was washed by agitation with about 20 times its weight of water, followed by squeezing out excess water, and drying at 110° C. for about 3 minutes. The mineral dyed fabric analyzed 1.50% chromium, the sodium hydroxide treatment bath contained 495 ppm chromium, and the water washing contained 436 ppm chromium. These results show that greater amounts of chromium are found in the wash baths by this conventional mineral dyeing procedure than was observed in the other examples of mineral dyeing cotton textiles by our new novel procedure and as recorded in Example 7. The mineral dyed fabric had a breaking strength of 141 lbs per inch comparable to that of the untreated greige duck's strength of 148 lbs per inch.

EXAMPLE 9

Greige cotton duck fabrics, 9 oz per yd weight, were mineral dye finished as in Example 7 to produce chromium oxide mineral dyed textiles that contained between 1.8 and 2.1% chromium for evaluating in weathering durability tests. Three mineral dyed specimens were evaluated in a xenon-arc accelerated weathering device programmed to stimulate rain by periodic spraying with water for 18 minutes every two hours over extended exposure through 500 hours. Mineral dyed fabrics that initially had chromium contents of 2.00, 1.91, and 2.01 percent were analyzed to have 1.94, 1.88, and 2.02 percent chromium after 100, 300, and 500 hours exposure to this accelerated weathering, respectively. The breaking strength of the mineral dyed fabrics was initially about 131 lbs per inch and after 100, 300, and 500 hours of this exposure were tested at 119, 101, and 91 lbs per inch, respectively. The untreated greige cotton duck fabric that was mineral dyed in this example had an initial breaking strength of 133 lbs per inch, and after 100, 300, and 500 hours of this same accelerated weathering was tested to have 99.7, 86.0, and 84.0 lbs per inch breaking strength, respectively.

Other specimens of the mineral dyed and untreated greige cotton fabric were exposed to outdoor weathering in New Orleans, LA, inclined at 45° facing the south and evaluated after 4, 9, and 12 months actual exposure to the elements. The mineral dyed specimens having initial percent chromium contents of 2.00, 2.01 and 1.95 were analyzed to have 2.11, 2.09 and 2.14 after the 4, 9, and 12 month periods, respectively. The breaking strengths of the weathered mineral dyed fabrics which was initially 131 lbs per inch was evaluated at 109, 80, and 76 lbs per inch after 4, 9, and 12 months of weathering, respectively. Similarly, the untreated greige cotton fabric which was initially 133 lbs per inch had breaking strengths of 107, 55 and 50, lbs per inch after 4, 9, and 12 months of weathering, respectively. After 12 months of weather exposure there was no evidence of mildew growth on the weathered mineral dyed fabrics, whereas mildew was observed on about 5 to 10% of the surface of the untreated weathered greige fabric.

EXAMPLE 10

Specimens of commercially mineral dyed pearl gray cotton duck fabric were exposed in the xenon arc weatherometer along with the fabrics in Example 9 and evaluated through 500 hours exposure with intermittent water spraying for 18 minutes every 2 hours. The mineral dyed fabric had an initial 1.89% chromium content and analyzed 1.84, 1.90, and 1.96% of chromium after 100, 300, and 500 hours exposure, respectively. The initial 137 lbs per inch breaking strength tested at 122, 89, and 84 lbs per inch at the respective 100, 300, and 500 hour exposure periods.

Other specimens of this commercially finished mineral dyed pearl gray cotton fabric were exposed on the outdoor weathering racks inclined at 45° facing south in New Orleans, LA, and when evaluated periodically indicated chromium contents of the exposed fabrics were 1.92, 1.85 and 1.81 percent, and breaking strength values were 98, 75, and 72 lbs per inch, after 4, 9, and 12 months of weather exposure, respectively. After 12 months weather exposure mildew growth was noted on about 5 to 10% of the surface of the weathered commercially finished mineral dyed gray fabric.

EXAMPLE 11

Nine greige cotton duck fabrics, of 9 oz per yd weight, were padded to about 56% wet pickup, with the mineral dye treatment formulation described in Example 7 and similarly processed to produce green chromium oxide mineral dyed textiles. The fabrics were divided into 3 groups of 3 fabrics each. The groups were exposed in a sulfur dioxide gas filled reaction chamber-two groups for 10 minutes each and the third for 30 minutes. Immediately after exposure, one fabric of each group was dried and heat cured for 4 minutes. A second for 8 minutes, and the third for 15 minutes. One of the groups of fabrics exposed to sulfur dioxide for 10 minutes and the group exposed for 30 minutes were cured at 160° C. while the remaining group exposed to sulfur dioxide gas for 10 minutes was cured at 180° C. The cured fabrics were washed in agitated water, dried and when analyzed indicated substantially the same chromium levels. For the fabrics cured for 4, 8, and 15 minutes at 160° C., the sulfur dioxide exposed samples had 1.82, 1.76, and 1.88% chromium, and those exposed for 30 minutes to sulfur dioxide had 1.90, 1.84 and 1.84% chromium, respectively. Those fabrics exposed for 10 minutes to sulfur dioxide and cured at 180° C. had 1.88, 1.81, and 1.87% chromium at the 4, 8, and 15 minute cure times, respectively.

I claim:

1. A vapor process for mineral dyeing cotton textiles by:

(a) impregnating a cellulosic fabric with an alkaline chromate salt solution;

(b) exposing the yellow chromium wetted cellulosic fabric to sulfur dioxide vapors;

(c) drying and curing the now greenish colored cellulosic fabric;

(d) washing the mineral dyed fabric with a sufficient quantity of water to remove the residual and resultant unwanted salts, alkali, etc.

2. The process of claim 1 including the additional step of drying the mineral dyed fabric at about 110° C. for about 2 to 5 minutes and the pad bath formulation for mineral dyeing cotton textiles of step (a) contains from about 3.5% to 5.0% chromium and consists of about 40 to 50 parts of a 20% sodium hydroxide solution to attain a pH of about 9.6 to 13.9, about 0.5 parts of a wetting agent and about from 0 to 30 parts of water.

3. The process of claim 2 wherein the pad bath formulation in which the chromium containing salt is selected from the group consisting of:

$(NH_4)_2Cr_2O_7$; $K_2CrO_4$; $Na_2CrO_4$; $(NH_4)_2CrO_4$; $Na_2Cr_2O_7$; $K_2Cr_2O_7$.

4. The process of claim 3 wherein the pad bath treating formulation to mineral dye cotton cellulosic fabric is a chromium-containing solution consisting of about 3 parts ammonium dichromate, about 7.5 parts ammonium carbonate, 0.6 parts zirconyl ammonium carbonate, and 0.5 parts wetting agent in about 90 parts water, and this reacted with about 40 parts of concentrated ammonium hydroxide to have a final pH of about 11.

5. A vapor process for producing a water repellent, mineral dyed cotton textile by:

(a) impregnating the cotton fabric to about 40% to 60% wet pickup with a formulation containing 1 to 3 parts of a 3% to 5% chromium content solution prepared from 40% to 60% of a 20% sodium dichromate dihydrate solution treated with 40% to 60% of a 10% to 20% sodium hydroxide solution to have a pH of 12.9, and 1 to 2 parts of a fungicidal/water repellent preparation containing about 13% pentachlorophenyl laurate and 13% paraffin wax, and (b) exposing this impregnated fabric to sulfur dioxide gas at room temperature for about 5 to 10 minutes, and (c) immediately drying and heat curing the green colored fabric at about 150° C. to 180° C. for about 4 minutes, (d) washing the now mineral dyed fabric and drying at 110° C. for about 2 to 5 minutes.

* * * * *